United States Patent [19]

Freeman et al.

[11] 4,110,578

[45] Aug. 29, 1978

[54] CIRCUIT BREAKER

[75] Inventors: Willie B. Freeman, Monroeville; Russell N. Yeckley, Murrysville; Otto H. Soles, N. Huntingdon; James M. Telford, Penn Hills, all of Pa.

[73] Assignee: Westinghouse Electric Corp., Pittsburgh, Pa.

[21] Appl. No.: 645,867

[22] Filed: Dec. 31, 1975

[51] Int. Cl.[2] ..... H01H 33/42

[52] U.S. Cl. ..... 200/148 F; 200/82 A

[58] Field of Search ..... 200/148 F, 148 R, 82 A

[56] References Cited

U.S. PATENT DOCUMENTS

| | | | |
|---|---|---|---|
| 2,667,554 | 1/1954 | Shores | 200/148 F |
| 2,681,958 | 6/1954 | Linde | 200/148 F |
| 3,824,361 | 7/1974 | Noack et al. | 200/148 F |
| 3,857,006 | 12/1974 | Daimon et al. | 200/148 F |

*Primary Examiner*—Robert S. Macon

*Attorney, Agent, or Firm*—M. S. Yatsko

[57] ABSTRACT

A compressed-gas insulated circuit breaker including two spaced apart electrical conductors within a sealed housing, a stationary contact electrically connected to one of the conductors, and a movable contact connected to the other conductor. The movable contact is coupled to a drive mechanism comprising a contact rod secured to the movable contact at one end, and pivotally coupled to a connecting rod at its other end. The connecting rod is pivotally coupled to one of a pair of arms fixedly secured to a rotatable positioning shaft. The other arm is pivotally coupled to a drive rod, and the drive rod is pivotally coupled to a centrally rotatable drive latch. The drive latch is secured to a rotation means, and upon rotation of the drive latch, the drive rod is moved, causing a rotation of the positioning shaft. Upon rotation of the positioning shaft, the connecting rod is moved, causing a longitudinal movement of the contact rod and the movable contact.

9 Claims, 2 Drawing Figures

CIRCUIT BREAKER

BACKGROUND OF THE INVENTION

This invention relates generally to circuit breakers, and more particularly to a compressed-gas insulated circuit breaker having a compact drive mechanism for positioning a movable contact within the circuit breaker.

The power demands of our country have reached such proportions that it is now necessary to transmit power to cities at voltages of 115,000 volts and upwards. Present practice is to use a cable system under the city streets with risers to outdoor substations and switch yards. The switch yards comprise the disconnect switches, circuit breakers, lightning arresters, transformers and auxiliary apparatus, so connected as to provide electrical service to local areas. With prior substation construction techniques, the area required for a typical, say 345 KV. substation, is indeed large. For such a substation, the total land requirements could approach 17 acres. Such large parcels of land may not be available at the desired locations.

One recent method utilized to reduce the space requirements for substations is the use of gas-insulated substations. In these gas-insulated substations, all electrical conductors are enclosed in grounded conducting pipes containing a pressurized high dielectric insulating medium such as sulfur-hexafluoride gas. The disconnect switches, circuit breakers and other components are included in the pressurized gas system, and are located above as well as alongside the power transformer to permit short bus runs and minimize space requirements. A typical gas-insulated substation can reduce the area and volume requirements to about 1/20 the requirement of a conventional, similarly sized station.

In addition to reducing the space requirements, the gas-insulated substations have additional advantages. The substations have lower installation and site preparation cost, mainly because of the lowered land acquisition costs, and the fact that the compressed-gas insulated systems have more compact pieces which can be factory assembled, thereby minimizing installation costs. Also, the gas insulated substations have superior reliability, less maintenance costs, and greater personnel safety, since the metal enclosures are grounded and operating personnel are protected from contact with electrically live parts. A further advantage of gas insulated substations is their environmental acceptability and adaptability. All components are enclosed in sulfur-hexafluoride gas, which provides for a quieter operation, and an operation which does not emit light, heat, gas, or arc combustion products to the atmosphere. Also, the gas-insulated substations are adaptable; they can easily be worked into the local environment and can be built inside a building or behind a architectural screen wall, or, if so desired, other structures can be built over them for multiple uses of available land.

In order to achieve the desired space reductions, all substations components should be designed to be as compact as possible. This requires not only that the active components be as closely spaced together as possible, but that their associated equipment, such as drive mechanisms, be as compact as possible and be capable of operating as close to the active components as possible.

SUMMARY OF THE INVENTION

A circuit breaker for use in compressed-gas insulated substations includes an elongated sealed gas housing with two spaced-apart electrical conductors disposed therein. Each conductor has connected to it a contact, and one of the contacts is longitudinally movable. The movable contact is coupled to a drive mechanism comprising a contact rod fixedly secured to the movable contact at one end, and pivotally connected to a connecting rod at the other end. The connecting rod is additionally pivotally coupled to an arm extending outwardly from a rotatable positioning shaft, and secured thereto. The positioning shaft has secured to it another arm, which is pivotally coupled to a drive rod, and the drive rod is pivotally coupled to a centrally rotatable drive latch. The drive mechanism also includes means for rotating the drive latch.

BRIEF DESCRIPTION OF THE DRAWINGS

For a better understanding of the invention, reference is now made to the description of the preferred embodiment, illustrated in the accompanying drawings, in which.

DESCRIPTION OF THE PREFERRED EMBODIMENT

Figure 1:
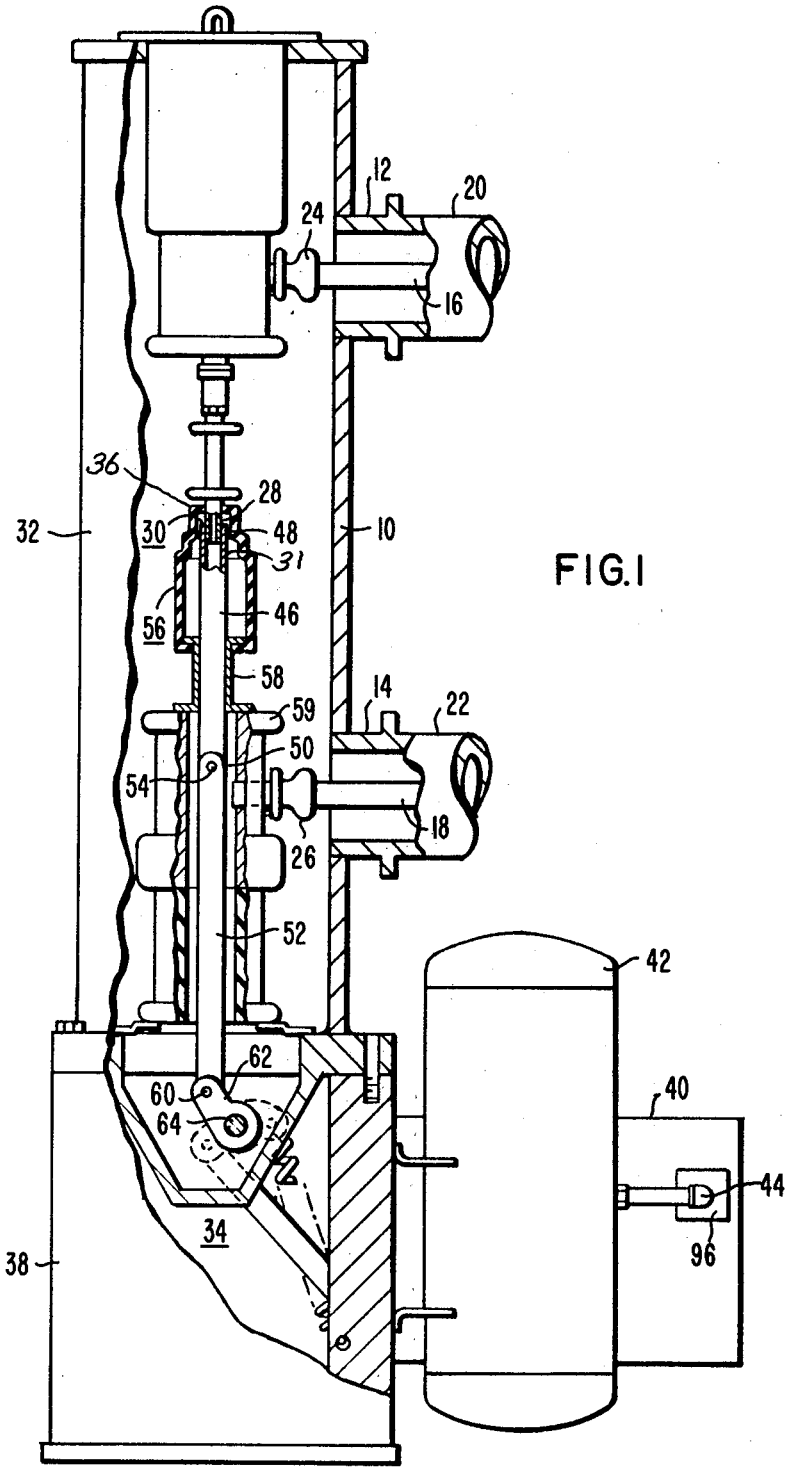
FIG. 1 is a sectional, elevational view of a circuit breaker of this invention.

Referring now more particularly to FIG. 1, the compressed-gas insulated circuit breaker of this invention comprises an elongated, generally cylindrical shell portion 10 having two ports 12, 14 through which electrical conductors 16 and 18 enter into the housing 10. The conductors 16, 18 are connected to the remainder of the substation by the gas-insulated transmission lines 20 and 22. The conductor 16 contacts an adapter 24, and the conductor 18 contacts an adapter 26, both of which are part of the circuit breaker. Electrically connected to one adapter 24 is a stationary contact 28. Electrically connected to the other adapter 26 is a longitudinally movable contact 30. The movable contact 30 is capable of being in two positions; one position in contact with the stationary contact 28; and one position spaced-apart from the stationary contact 28. When the movable contact 30 is in electrical contact with the stationary contact 28, the circuit breaker is considered closed, and electric current is permitted to flow from the electrical conductor 16 to the electrical conductor 18. As would be appreciated by one skilled in the art, the circuit breaker illustrated in FIG. 1 is of a modular design, and interrupts the flow of electrical current for one phase only. To provide for circuit interruption of a plurality of phases, a plurality of similar circuit breakers would be utilized. A more detailed description of the use of modular-type circuit interrupters is found in application for patent Ser. No. 645,753, filed Dec. 31, 1975 and assigned to the same assignee of the present invention.

As heretofore mentioned, the circuit breaker of this invention is utilized in compressed-gas insulated substations. As such, the area 32 within the sealed housing 10 would be filled with a high dielectric insulating gas such as sulfur-hexafluoride. The use of sulfur-hexafluoride as an insulating gas permits the close arrangement of component parts, for example, between the electrical conductors 16 and 18, and between the contacts 28 and 30, and the housing 10.

The movable contact 30 is in electrical contact with the stationary contact 28 until it is desired to stop the flow of electric current from conductor 16 to conductor 18. When it is desired to interrupt this current flow, the movable contact 30 is moved away from the stationary contact 28 by a drive mechanism 34. As the movable contact 30, which comprises a finger contact 31, a nozzle 36, and a cylinder 56 becomes spaced-apart from the stationary contact 28, any arc created between the two contacts 28 and 30 by their becoming spaced-apart is extinguished. A detailed description of the means utilized to quench the arc may be found in application for patent Ser. No. 645,752, filed Dec. 31, 1975 and assigned to the same assignee as the present invention.

The sealed housing 10 is positioned on, and supported by, a breaker support 38. The breaker support 38 also supports part of the drive mechanism 34. Located adjacent to the breaker support 38 is a drive mechanism housing 40, in which the remainder of the drive mechanism 34 is disposed. Externally of the drive mechanism housing 40 is a compressed air tank 42. The compressed air tank 42 is in fluid communication with the drive mechanism 34 by means such as the piping 44. The purpose of the compressed air within the tank 42 will be hereinafter explained in the detailed description of the drive mechanism 34.

The drive mechanism 34 comprises a contact rod 46 which is secured at one end 48 to the movable contact 30. The other end 50 of the contact rod 46 is pivotally coupled to a connecting rod 52 by means such as the pin 54. The contact rod 46 travels with an cylinder 56, disposed within the gas housing 10, and disposed within the cylinder 56 are guide means and piston 58. The guide means and piston 58 are disposed adjacent to the contact rod 46, are fixedly secured to a stationary holder 59, and are for the purpose of maintaining the movement of the contact rod 46 in a substantially straight-lined longitudinal movement while providing compression of the $SF_6$ gas for arc interruption.

Figure 2:
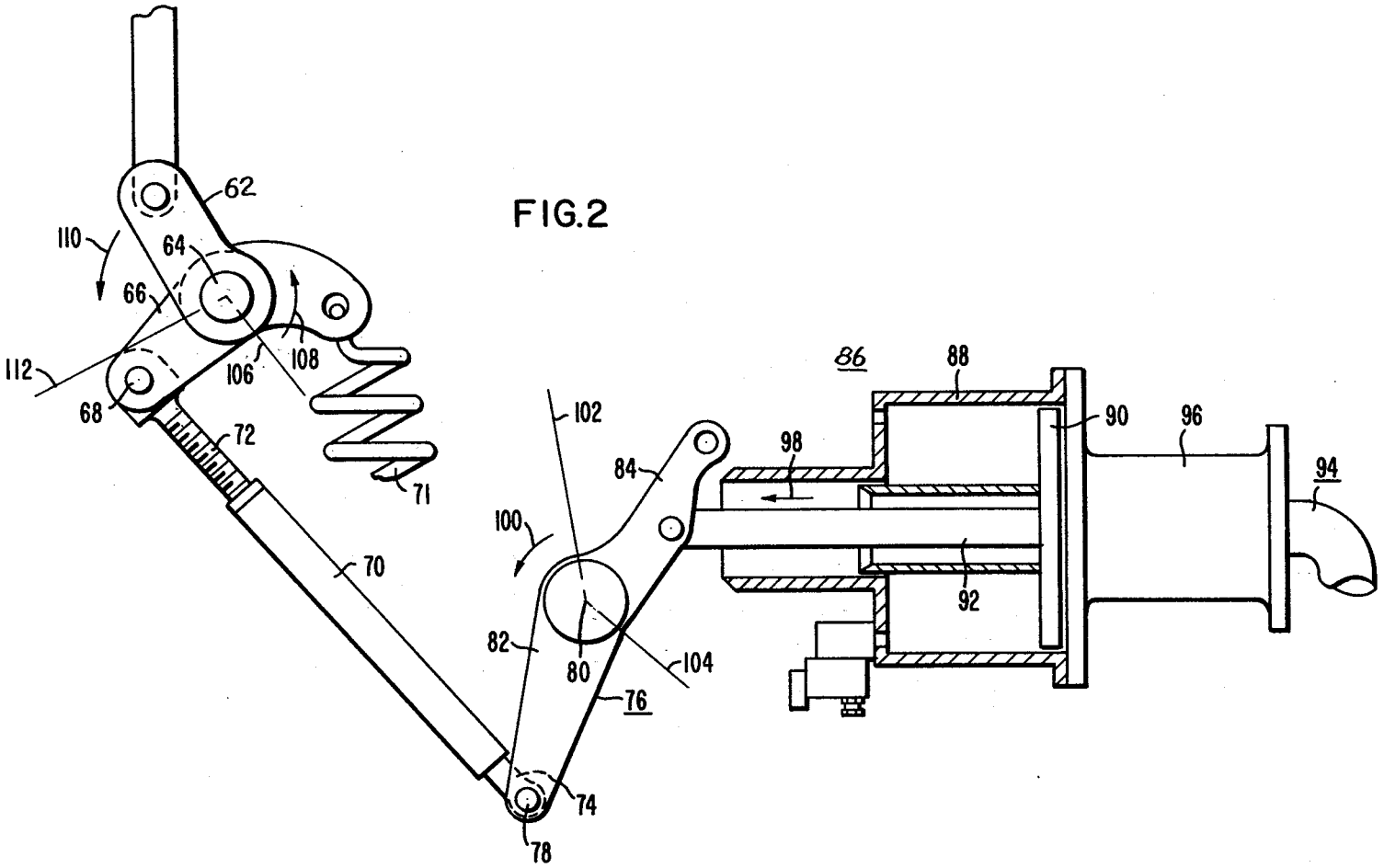
FIG. 2 is a detailed view of the drive mechanism utilized in the circuit breaker.

The connecting rod 52 is pivotally coupled, by means such as the pin 60, to an arm 62. The arm 62 is fixedly secured to a rotatable positioning shaft 64 which extends outwardly beyond the gas housing 10 and is disposed within the breaker support 38. The rotation of the positioning shaft 64 is accomplished by the remainder of the drive mechanism 34, as illustrated in FIG. 2.

Fixedly secured to the positioning shaft 64 is a second arm 66. Pivotally coupled to the second arm 66, by means such as the pin 68, is a drive rod 70. Although the coupling between the drive rod 70 and the second arm 66 is shown as being through a threaded bolt 72 inserted into the drive rod 70, the invention can be utilized if the portion represented by the bolt 72 is an integral part of the drive rod 70. Also secured to the positioning shaft 64 is a biasing spring 71 which is loaded upon rotation of the positioning shaft 64. The other end of the biasing spring 71 is secured to the support 38.

The drive rod 70 is pivotally coupled, at its opposite end 74, to a centrally rotatable drive latch 76. This pivotal coupling may be accomplished by the pin 78. The drive latch 76 is rotatable about its centrally disposed axis 80. The drive latch 76 is composed of two sections 82, 84. The first section 82 is pivotally coupled to the drive rod 70. The second end section 84 is secured to a means 86 for rotating drive latch 76. Although illustrated as a one piece latch, the drive latch 76 can be considered as being a centrally rotatable drive shaft having two radially outwardly extensions secured thereto and corresponding to the two end sections 82, 84. The drive latch 76 is supported through its centrally located axis 80.

The drive latch rotation means 86 comprises a sealed cartridge or housing 88 in which is positioned a rigid disc 90. The disc 90 has a diameter substantially equal to the diameter of the cartridge 88. Fixedly secured to the disc 90 is a latch rod 92 which extends outwardly beyond the cylinder 88, and which is pivotally secured to the second end section 84. Also included within the drive latch rotation means 86 are a means 94 for inserting a driving fluid within the cylinder 88 and against the disc 90. This insertion means 94 includes the compressed air within the tank 42 (see FIG. 1) and a valve means 96 for facilitating or prohibiting the flow of compressed air from the tank 42 to the disc 90.

The drive mechanism 34, and the movable contact 30, are illustrated in the closed position in FIGS. 1 and 2. To position the movable contact 30 in a spaced-apart relationship with the stationary contact 28, the drive mechanism 34, and movable contact 30, operate as follows. The valve means 96 are opened, and permit the flow of compressed air from the tank 42 to the cylinder or piston 88. The air flows inside the cylinder 88 and exerts a force against the disc or head 90. The force of the air causes a movement of the disc 90 in the direction shown by arrow 98, and causes a corresponding movement of the latch rod or piston rod 92. The movement of the latch rod 92 causes a rotation of the drive latch 76 in the direction of the arrow 100. The rotation of the drive latch 76 causes a movement, first, of the end segment 84 to the position schematically illustrated by the center line 102. As the end section 84 and the end section 82 are integrally formed as the drive latch 76, the end section 82 is rotationally moved to the position indicated by the center line 104. The movement of the end section 82 causes a movement of the drive rod 70 which is pivotally coupled to its such that the pivotal pin 78 also falls on the line 104, thereby latching the linkage and contacts 28, 30 in the open position. This movement of the drive rod 70 causes the second arm 66 to which the drive rod 70 is coupled to move to the position indicated by the line 106. Since the second arm 66 is fixedly secured to the positioning shaft 64, the movement of the second arm 66 causes a rotation of the positioning shaft 64 in the direction indicated by arrow 108. This rotation also causes the biasing spring 71 to be tensioned or loaded, resulting in a biasing of the positioning shaft 64. The rotation of the positioning shaft 64 causes a movement of the arm 62 which is fixedly secured to it in the direction shown by arrow 110, and the second arm 62 is moved to a position indicated by line 112. The movement of the arm 62 causes a movement of the connecting rod 52 which is pivotally coupled to the arm 62. The longitudinal movement of the connecting rod 52 causes a corresponding longitudinal movement of the contact rod 46 which is pivotally coupled to it. The contact rod 46, is contained by the guide means 58, and is forced to traverse a substantially straight line motion. This straight line motion of the contact rod 46 causes the movable contact 30 fixedly secured thereto to move longitudinally away from the stationary contact 28 and become spaced-apart therefrom. Once the movable contact 30 is spaced-apart from the stationary contact 28, the flow of electric current from the conductor 16 to the conductor 18 is prohibited.

Thus, the invention discloses a compact circuit breaker for use in a compressed gas insulated substation, and which utilizes a compact drive mechanism for positioning the movable contact in its relationship with the stationary contact to provide circuit interruption.

We claim as our invention:

1. A circuit breaker for use in compressed-gas insulated systems comprising:

an elongated sealed gas housing containing a compressed insulating gas and including two spaced-apart electrical conductors;

a stationary contact disposed within said housing and electrically connected to one of said electrical conductors;

a longitudinally movable contact disposed within said housing and electrically connected to the other of said electrical conductors, said movable contact capable of electrically contacting said stationary contact and capable of being spaced-apart from said stationary contact;

a contact rod secured at one end to said movable contact and having a free end;

guide means disposed within said housing and positioned adjacent to said contact rod, said guide means permitting said contact rod longitudinal movement;

a connecting rod pivotally coupled to said free end of said contact rod, a rotatable positioning shaft having a pair of arms fixedly secured thereto and extending radially outwardly therefrom, said positioning shaft extending outwardly beyond said housing, said connecting rod being pivotally coupled to one of said arms;

a drive rod pivotally coupled at one end directly to one of said arms and having a free end;

a centrally rotatable drive latch having a first end section and a second end section, said drive rod free end being pivotally coupled directly to said first end section; and means for rotating said drive latch comprising:

a sealed cylinder;

a rigid disc disposed within said cylinder and movable with respect thereto, said disc having a diameter substantially the same as said cylinder;

a latch rod secured to said disc and extending outwardly beyond said cylinder, said latch rod being secured directly to said drive latch second end section; and means for inserting a driving fluid within said cylinder and against said disc, said driving fluid causing movement of said disc and said latch rod, movement of said latch rod causing rotation of said drive latch.

2. The circuit breaker according to claim 1 wherein said insulating gas is sulfur-hexafluoride.

3. The circuit breaker according to claim 1 wherein said driving fluid is compressed air.

4. A drive mechanism for use with circuit breakers having a stationary contact and a movable contact wherein the position of said movable contact with respect to said stationary contact controls the flow of electric current therebetween, said drive mechanism positioning said movable contact and comprising:

a movable positioning rod secured to said movable contact;

a rotatable positioning rod secured to said movable contact;

a rotatable positioning shaft coupled to said positioning rod, rotation of said positioning shaft moving said positioning rod and positioning said movable contact with respect to said stationary contact;

a movable drive rod coupled directly to said positioning shaft and causing rotation thereof upon movement of said drive rod;

a rotatable drive shaft having a radially outward extension fixedly secured thereto, said drive rod being pivotally coupled directly to said drive shaft extension, rotation of said drive shaft and said drive shaft extension causing movement of said drive rod, said drive shaft extension comprising an arm centrally secured to said drive shaft and having two sections extending outwardly beyond said drive shaft, one of said arm sections being pivotally coupled to said drive rod; and means for causing rotation of said drive shaft comprising a piston including:

a sealed piston housing;

a piston head disposed within said piston housing and movable with respect thereto;

a piston rod fixedly secured to said piston head and extending outwardly beyond said piston housing, said piston rod being secured directly to one of said drive shaft extension arm sections; and means for inserting a driving fluid within said piston and against said piston head, said driving fluid causing movement of said piston head and said piston rod, movement of said piston rod causing rotation of said drive shaft.

5. The drive mechanism according to claim 4 wherein said positioning shaft has a radially outward first extension fixedly secured thereto; and said positioning rod comprises:

a contact rod fixedly secured to said movable contact; and a connecting rod pivotally coupled to said contact rod and to said positioning shaft first extension, whereby rotation of said positioning shaft causes arcuate movement of said positioning shaft first extension, causing movement of said connecting rod and said contact rod to position said movable contact.

6. The drive mechanism according to claim 5 wherein guide means are positioned longitudinally adjacent said contact rod, said guide means restricting movement of said contact rod to a generally straight line motion.

7. The drive mechanism according to claim 4 wherein said positioning shaft has a radially outward second extension fixedly secured thereto; and said drive rod is pivotally coupled to said positioning shaft second extension, whereby movement of said drive rod causes a rotation of said positioning shaft.

8. The drive mechanism according to claim 4 wherein said drive shaft rotation means includes a latch rod secured to one of said arm sections, movement of said latch rod causing rotation of said drive shaft.

9. The drive mechanism according to claim 4 wherein said driving fluid is compressed air.

* * * * *